United States Patent [19]

Antoniak

[11] 4,441,623

[45] Apr. 10, 1984

[54] RESILIENT CLOSURE

[76] Inventor: Nickolas J. Antoniak, 896 W. 15th Ave., Vancouver, British Columbia, Canada, V5Z 1R7

[21] Appl. No.: 389,310

[22] Filed: Jun. 17, 1982

[51] Int. Cl.[3] ..... B65D 41/26

[52] U.S. Cl. ..... 220/90.4; 229/7 S

[58] Field of Search ..... 220/90.2, 90.4, 90.6, 220/268, 254; 229/7 R, 7 S

[56] References Cited

U.S. PATENT DOCUMENTS

| | | | |
|---|---|---|---|
| 3,335,901 | 8/1967 | Edwards | 220/90.2 |
| 3,797,696 | 3/1974 | Dibrell | 220/90.4 |
| 3,860,162 | 1/1975 | Schutz | 220/90.4 X |
| 3,952,910 | 4/1976 | Wheeler | 220/90.4 |
| 4,090,660 | 5/1978 | Schram et al. | 220/90.2 X |
| 4,186,842 | 2/1980 | Albert | 220/90.4 X |
| 4,210,256 | 7/1980 | Ambers et al. | 220/90.4 X |
| 4,350,260 | 9/1982 | Prueher | 220/268 X |

*Primary Examiner*—Allan N. Shoap

*Attorney, Agent, or Firm*—Townsend and Townsend

[57] ABSTRACT

A resilient closure to be received on a container for a liquid. The closure has a raised periphery that defines a channel to engage on the container to form a seal around the container. There is a valve in the surface of the closure adjacent the raised periphery. The valve is movable between a closed and an open position but tends to remain closed in the absence of an external force. A lever is formed integrally with the closure and is raised above the surface. The lever ends adjacent the valve and the arrangement is such that downward pressure applied to the lever opens the valve to allow liquids to pass from the container. The release of the lever allows the valve to return to the closed position. The valve comprises a slit in the surface of the closure starting at and extending away from an edge of the lever.

5 Claims, 3 Drawing Figures

RESILIENT CLOSURE

FIELD OF THE INVENTION

This invention relates to a resilient closure to be received on a container for any liquid, especially a soft drink.

DESCRIPTION OF THE PRIOR ART

The container art is replete with examples of attempts to produce non-spill lids for soft drinks. Such drinks are frequently purchased at fast food outlets and may be consumed in a car. The spilling of the drinks produces the obvious disadvantage of liquid in the car but also the drinks are usually high in sugar, producing a sticky mess. They are also frequently coloured, thus staining upholstery and frequently drunk by children, who are more likely to spill the drink by knocking over the container.

As a result of the above several attempts have been made to produce non-spill lids, that is, a container closure that can be placed on the container and left with confidence that the drink will not spill even if the container is knocked over. Previous attempts have met with little success. Flexible closures are certainly known for soft drinks and for coffee, tea and the like but they are normally only used while the container, with the drink in it, is carried to the place of consumption. At that place the lid is removed and discarded.

There have been attempts in the prior art to produce container tops that have valves or flaps in them that can be opened when a person wishes to drink, and closed when the drink is put to one side. Desirably, of course, the closure of the opening or flap is done automatically. An example of such prior art is shown in U.S. Pat. No. 4,210,256 to Amberg et al. However, the structure shown is relatively complicated and, at least by the standards that must apply for these closures, which are usually disposable, relatively expensive to produce.

SUMMARY OF THE INVENTION

The present invention seeks to produce a device that will not cost more to produce than existing lids, is effective in operation even though it is used a number of times, and, indeed, meets all the problems listed above.

Accordingly, the present invention is a resilient closure to be received on a container for a liquid, the closure comprising: a raised periphery defining a channel to engage on the container to form a seal around the container; a valve in the surface of the closure adjacent the periphery and movable between a closed and an open position but tending to remain closed in the absence of an external force; a lever formed integrally with the closure and raised above the surface and ending generally adjacent the flap whereby downward pressure applied to the lever opens the flap to allow liquids to pass from the container but release of the lever allows the flap to return to the closed position.

The valve may be a simple slit cut in the closure or a flap.

In a desirable aspect the closure is made in one piece from a synthetic resin that possesses the necessary resilience.

BRIEF DESCRIPTION OF THE DRAWINGS

Aspects of the invention are illustrated in the drawings in which.

DESCRIPTION OF THE PREFERRED EMBODIMENTS

Figure 1:
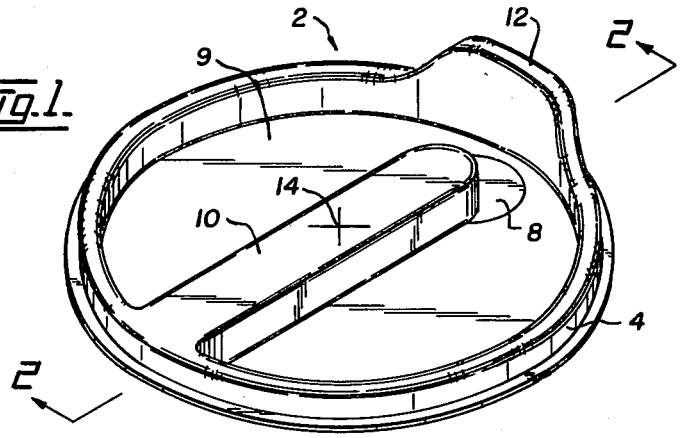
FIG. 1 is a perspective view of a preferred embodiment of the invention.

FIG. 1 shows a resilient closure 2 to be received on a container (not shown). The closure has a raised periphery 4 which defines a channel 6 to engage on the container to form a seal around the container. It will be recognized that in this regard the closure 2 is conventional. That is, the typical protective device for a soft drink container typically has a periphery to engage on the top of the container.

Figure 2:
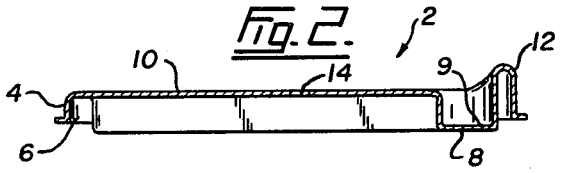
FIG. 2 is a section on the line 2—2 in FIG. 1.
Figure 3:
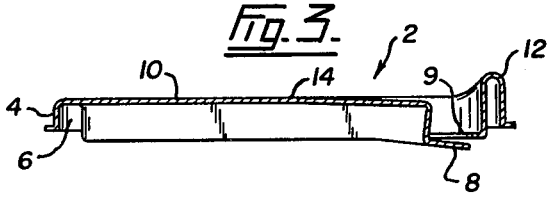
FIG. 3 is a view similar to FIG. 2.

The closure 2 according to the invention has a valve in the form of a flap 8 in the surface 9 of the closure adjacent the periphery. This flap 8 is movable between a closed position as shown in FIG. 2 to an open position as shown in FIG. 3, but, due to the resilience of the material for which the closure is made, it tends to the closed position, that is the position shown in FIG. 2. In this regard surface 9 is a smooth area face of interruptions other than a lever 10 formed intergrally with the surface 9. Lever 10 is raised above the surface 9 and ends at the flap 8. In the illustrated embodiment the lever 10 extends from, and is continuous with, the periphery 4 and ends overlapping the flap 8 as shown particularly in FIG. 3.

In the illustrated embodiment there is a raised portion 12 in the periphery 4, generally adjacent the flap 8, to facilitate drinking. There may also be an opening 14 for a straw in the form of cross slits. Again, due to the resilient nature of the materials for which the closure is made the slits remain closed when a straw is not positioned in it.

It is desirable that the periphery 4 be formed with a crown or half radius at 12 to increase the strength of the device and to assist in location on the container, see FIGS. 2 and 3.

Although the flap 8 as shown as a circle it will be appreciated that the shape is immaterial. The flap 8 may also be replaced by a simple slit. The closure 2 according to the present invention may be made of PVC, polyethylene or any other similar known and, preferably, cheap plastic. In this regard it will be appreciated that the closure 2 is normally intended as a throw-away device, that is, to be used once and then discarded. The flap 8 need not be located as close to the lever 10 as shown. It is sufficient if flap 8 is generally adjacent the end of lever 10 as the uninterrupted surface 9 ensures that in those circumstances flap 8 will still open when lever 10 is pressed.

To use the closure according to the present invention the closure 2 is placed on a container and experimental trials have shown that with the closure 2 in position on a properly dimensioned container there is no leakage even though the container be knocked over. When it is desired to drink from the container then the drinker applies pressure to the lever 10 at any point along its length. The flap 8 is opened, as shown in FIG. 3, and the drinker may place his or her mouth on the raised portion 12 to drink from the container. Release of the pressure from the lever 10 allows the flap 8 to close. It should be noted that the nose or upper lip can be used to apply pressure to the lever 10, that is, it need not necessarily be the pressure of the fingers.

The arrangement according to the present invention is particularly useful because of the fulcrum ability of the lever 10 and its relationship to the opening. Even after some considerable use in experiments the flap 8 still returns to the closed position as soon as pressure is released from the lever 10. In this regard the fact that flap 10 ( or the equivalent valve that may be used) is an integral part of surface 9 formed simply by cutting surface 9. This ensures smooth operation particularly immediate transfer of any stress applied to the lever 10 to the surface 9 and thus flap 8. Similarly as soon as stress is removed from the lever 10 the surface 9 and thus the flap 8 return to the rest or closed position. The present closure is the first to use this close relationship between an operating lever and a surface and a valve formed in that surface.

I claim:

1. A resilient closure to be received on a container for a liquid, the closure comprising;

a raised periphery defining a channel to engage on the container to form a seal around the container;

a valve in the surface of the closure adjacent the raised periphery and movable between a closed and an open position but tending to remain closed in the absence of an external force;

a lever formed integrally with the closure and raised above the surface, extending generally from the periphery diametrically opposed to said valve across the surface and ending generally adjacent the valve whereby downward pressure applied generally to the lever opens the value to allow liquids to pass from the container but release of the lever allows the valve to return to the closed position, the valve comprising a slit in the surface of the closure starting at and extending away from an edge of the lever, the valve comprising a flap forming a portion of the circumference of a circle arranged around the end of the lever, the flap being defined by the slit extending away from an edge of the lever, around but spaced from the end of the lever to meet the lever at a second edge of the lever, the flap being attached to the closure at a joint contiguous with the end of the lever.

2. A resilient closure as claimed in claim 1 molded in one piece of a synthetic resin.

3. A resilient closure as claimed in claim 1 including a raised portion in the periphery, generally adjacent the valve, to facilitate drinking by acting as a lip rest.

4. A resilient closure as claimed in claim 1 in which the raised periphery is formed with a crown half radius.

5. A resilient closure to be received on a container for a liquid, and comprising:

a flexible surface;

a peripheral channel around the flexible surface to locate the closure on the container;

a lever integral with the closure and above the surface, the lever extending from the peripheral channel at one side of the closure across the flexible surface;

the surface being substantially flat except for the presence of the lever;

a flap valve positioned in the surface, close to the peripheral channel adjacent the end of the lever diametrically opposed to said one side, whereby downward pressure applied to the lever opens the flap to allow liquids to pass from the container but release of the lever allows the flap to return to the closed position, the flap valve being formed by a slit in the surface, the slit starting at a point on a first edge of the lever and extending in a path spaced from the end of the lever round to contact a second point on a second edge of the lever, the flap being attached to the closure at a joint contiguous with the end of the lever.

* * * * *